US012331484B2

(12) United States Patent
Ito et al.

(10) Patent No.: US 12,331,484 B2
(45) Date of Patent: Jun. 17, 2025

(54) WORK MACHINE

(71) Applicant: Hitachi Construction Machinery Co., Ltd., Tokyo (JP)

(72) Inventors: Masamichi Ito, Toride (JP); Koji Shiwaku, Tsuchiura (JP); Shinya Kasai, Kashiwa (JP)

(73) Assignee: Hitachi Construction Machinery Co., Ltd, Tokyo (JP)

( * ) Notice: Subject to any disclaimer, the term of this patent is extended or adjusted under 35 U.S.C. 154(b) by 188 days.

(21) Appl. No.: 18/024,695

(22) PCT Filed: Feb. 1, 2022

(86) PCT No.: PCT/JP2022/003902
§ 371 (c)(1),
(2) Date: Mar. 3, 2023

(87) PCT Pub. No.: WO2022/196145
PCT Pub. Date: Sep. 22, 2022

(65) Prior Publication Data

US 2023/0323631 A1 Oct. 12, 2023

(30) Foreign Application Priority Data

Mar. 19, 2021 (JP) ..... 2021-046381

(51) Int. Cl.
*E02F 9/20* (2006.01)
*E02F 9/24* (2006.01)
*E02F 9/26* (2006.01)

(52) U.S. Cl.
CPC ..... *E02F 9/205* (2013.01); *E02F 9/268* (2013.01); *E02F 9/24* (2013.01)

(58) Field of Classification Search
CPC ... E02F 9/205; E02F 9/268; E02F 9/24; E02F 3/435; E02F 9/2203; E02F 9/2285;
(Continued)

(56) References Cited

U.S. PATENT DOCUMENTS

2003/0236102 A1* 12/2003 Kawai ..... G06F 1/166 455/575.8
2005/0054450 A1* 3/2005 Yamaguchi ..... A63H 30/04 463/58

(Continued)

FOREIGN PATENT DOCUMENTS

CN 111827386 A 10/2020
JP 2015-191249 A 11/2015

(Continued)

OTHER PUBLICATIONS

Extended European Search Report issued in European Application No. 22770907.8 dated Aug. 6, 2024 (9 pages).

(Continued)

*Primary Examiner* — Donald J Wallace
*Assistant Examiner* — Jalal C Coduroglu
(74) *Attorney, Agent, or Firm* — Crowell & Moring LLP

(57) ABSTRACT

Provided is a work machine including a front work device, the work machine including a state amount sensor that senses a state amount relating to an action state of the work device and a controller that controls an action of the work machine on the basis of an operation signal transmitted from a remote device by radio communication. The controller assesses a communication status of the radio communication, and, when restricting the action of the work machine on the basis of a result of the assessment, eases the restriction on the action of the work machine, depending on a sensing result from the state amount sensor. As a result, it is possible to appropriately restrict action on the basis of a communication status, while suppressing worsening of workability.

1 Claim, 13 Drawing Sheets

(58) Field of Classification Search
CPC ..... E02F 9/2292; E02F 9/2296; E02F 9/26; B60Y 2200/412
See application file for complete search history.

(56) References Cited

U.S. PATENT DOCUMENTS

| | | | | |
|---|---|---|---|---|
| 2007/0288124 | A1* | 12/2007 | Nagata | B25J 13/088 901/46 |
| 2011/0237246 | A1* | 9/2011 | Sen | H04W 72/541 455/426.1 |
| 2014/0121840 | A1* | 5/2014 | Mizuochi | G06F 30/15 700/275 |
| 2015/0054629 | A1* | 2/2015 | Schulenberg | G08C 17/02 340/12.3 |
| 2015/0310736 | A1* | 10/2015 | Yamada | H04B 5/72 398/107 |
| 2018/0258899 | A1* | 9/2018 | Ikiyama | F02N 11/0818 |
| 2019/0063041 | A1* | 2/2019 | Izumi | F02D 29/02 |
| 2020/0057437 | A1* | 2/2020 | Minagawa | H04Q 9/00 |
| 2020/0174465 | A1* | 6/2020 | Minagawa | E02F 9/267 |
| 2020/0208373 | A1* | 7/2020 | Nakamura | G01G 19/08 |
| 2020/0232189 | A1* | 7/2020 | Yamanobe | E02F 9/26 |
| 2021/0266715 | A1* | 8/2021 | Uchiyama | H04W 4/48 |
| 2022/0049453 | A1* | 2/2022 | Izumi | E02F 9/268 |
| 2022/0145580 | A1* | 5/2022 | Igarashi | E02F 9/2029 |

FOREIGN PATENT DOCUMENTS

| | | | |
|---|---|---|---|
| JP | 2016-166511 | A | 9/2016 |
| JP | 2017-227019 | A | 12/2017 |
| JP | 2019-65657 | A | 4/2019 |
| JP | 2019-68346 | A | 4/2019 |
| JP | 2019-214833 | A | 12/2019 |
| JP | 2020-2709 | A | 1/2020 |

OTHER PUBLICATIONS

Chinese-language Office Action issued in Chinese Application No. 202280005921.X dated Aug. 5, 2024 with partial English translation (11 pages).

International Search Report (PCT/ISA/210) issued in PCT Application No. PCT/2022/003902 dated Apr. 26, 2022 with English translation (five (5) pages).

Japanese-language Written Opinion (PCT/ISA/237) issued in PCT Application No. PCT/2022/003902 dated Apr. 26, 2022 (four (45) pages).

International Preliminary Report on Patentability (PCT/IB/338 & PCT/IB/373) issued in PCT Application No. PCT/JP2022/003902 dated Sep. 28, 2023, Including English translation (Japanese-language Written Opinion (PCT/ISA/237), filed on Mar. 3, 2023) (6 pages).

* cited by examiner

WORK MACHINE

TECHNICAL FIELD

The present invention relates to a work machine.

BACKGROUND ART

As a technology concerning remote operation of a work machine, for example, Patent Document 1 discloses a work vehicle including an imaging device for picking up an image of an object of work, an image transmission section that transmits the image picked up by the imaging device to a controller, an operation signal reception section that receives an operation signal from the controller, and an action control section that restricts the operation signal according to a transmission status of the image.

PRIOR ART DOCUMENT

Patent Document

Patent Document 1: JP-2019-068346-A

SUMMARY OF THE INVENTION

Problem to be Solved by the Invention

However, in the above-described prior art, for example, when a communication delay time is suddenly elongated, the work machine would suddenly be stopped in the case where an operation signal of the work machine is restricted according to a communication status. Hence, for example, in the case where the work machine is suddenly stopped when the work machine is loading earth in a bucket, there is a risk that the earth as the load would be scattered. In addition, depending on the work posture, there is a risk that the stability of the machine body is markedly lowered due to the sudden stop. In other words, in the above-described prior art, there is a fear of worsening of workability due to scattering of the load or lowering in the stability of the work machine caused by a sudden stop.

The present invention has been made in consideration of the abovementioned problem, and it is an object of the present invention to provide a work machine capable of appropriately restricting an action according to the communication status while suppressing worsening of workability.

Means for Solving the Problem

While the present application includes a plurality of types of means for solving the above-described problem, an example of the means is a work machine including a front work device, the work machine including a state amount sensor that senses a state amount relating to an action state of the front work device, and a controller that controls the action of the work machine on the basis of an operation signal transmitted from a remote operation device by radio communication, in which the controller is configured to assess a communication status of the radio communication, and, when restricting the action of the work machine according to a result of the assessment, ease the restriction on the action of the work machine according to a result sensing performed by the state amount sensor.

Advantages of the Invention

According to the present invention, an action can appropriately be restricted according to the communication status, while worsening of workability is suppressed.

MODE FOR CARRYING OUT THE INVENTION

Figure 1:
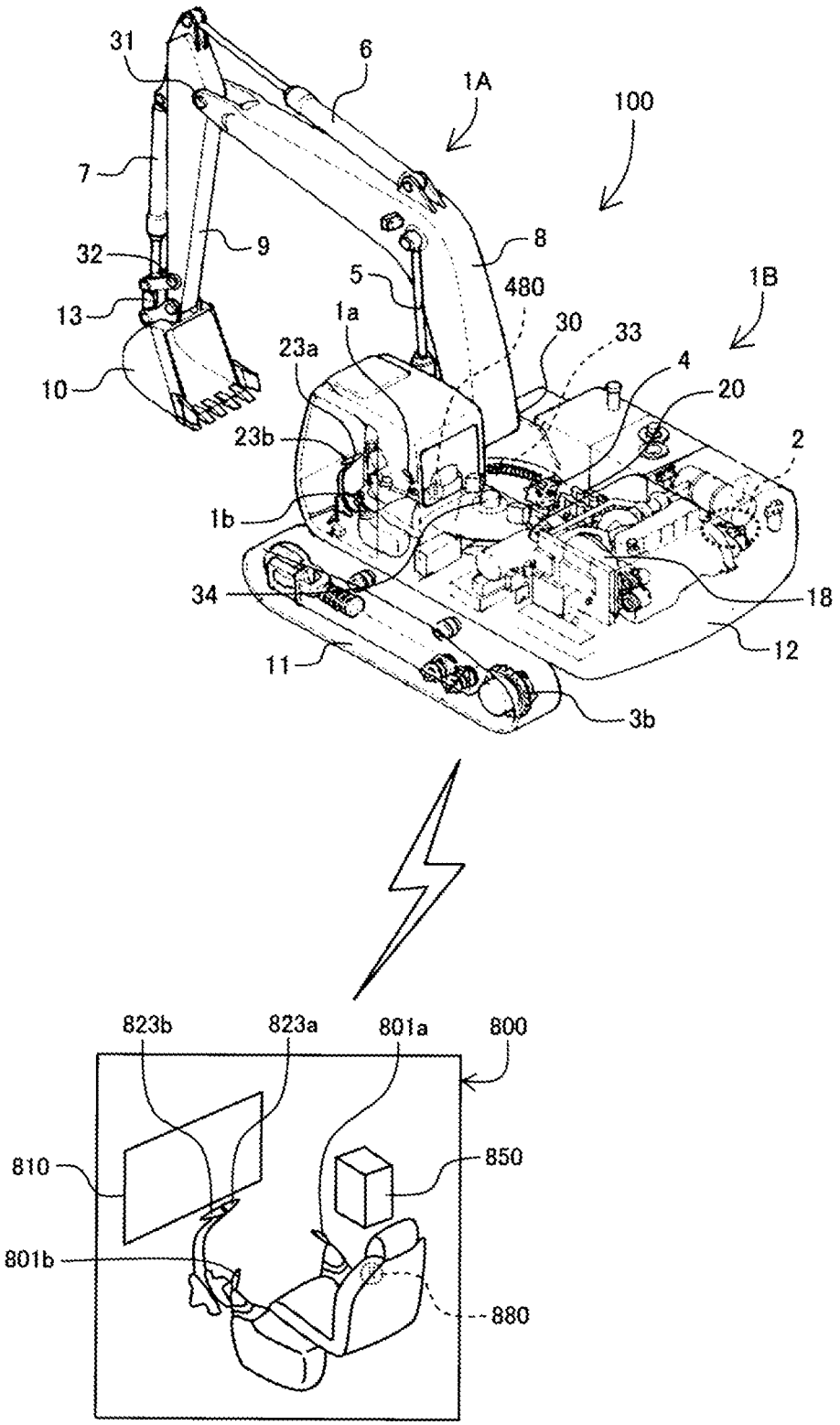
FIG. 1 is a diagram schematically depicting the appearance of a hydraulic excavator, which is an example of a work machine, together with a remote operation device.

An embodiment of the present invention will be described below with reference to the drawings. Note that in the following description, a hydraulic excavator including a front work device will be illustrated and described as an example of a work machine, but the present invention can be applied also to work machines other than the hydraulic excavator.

In addition, in the following description, in the case where there are a plurality of the same constituent elements, an alphabet may be added to the last end of a reference character (numeral), but the plurality of constituent elements may collectively be noted by omitting the alphabet. Specifically, for example, when two hydraulic pumps 2*a* and 2*b* are present, these may collectively be noted as pumps 2.

First Embodiment

A first embodiment of the present invention will be described with reference to FIGS. 1 to 15.

<Fundamental Configuration>

Figure 2:
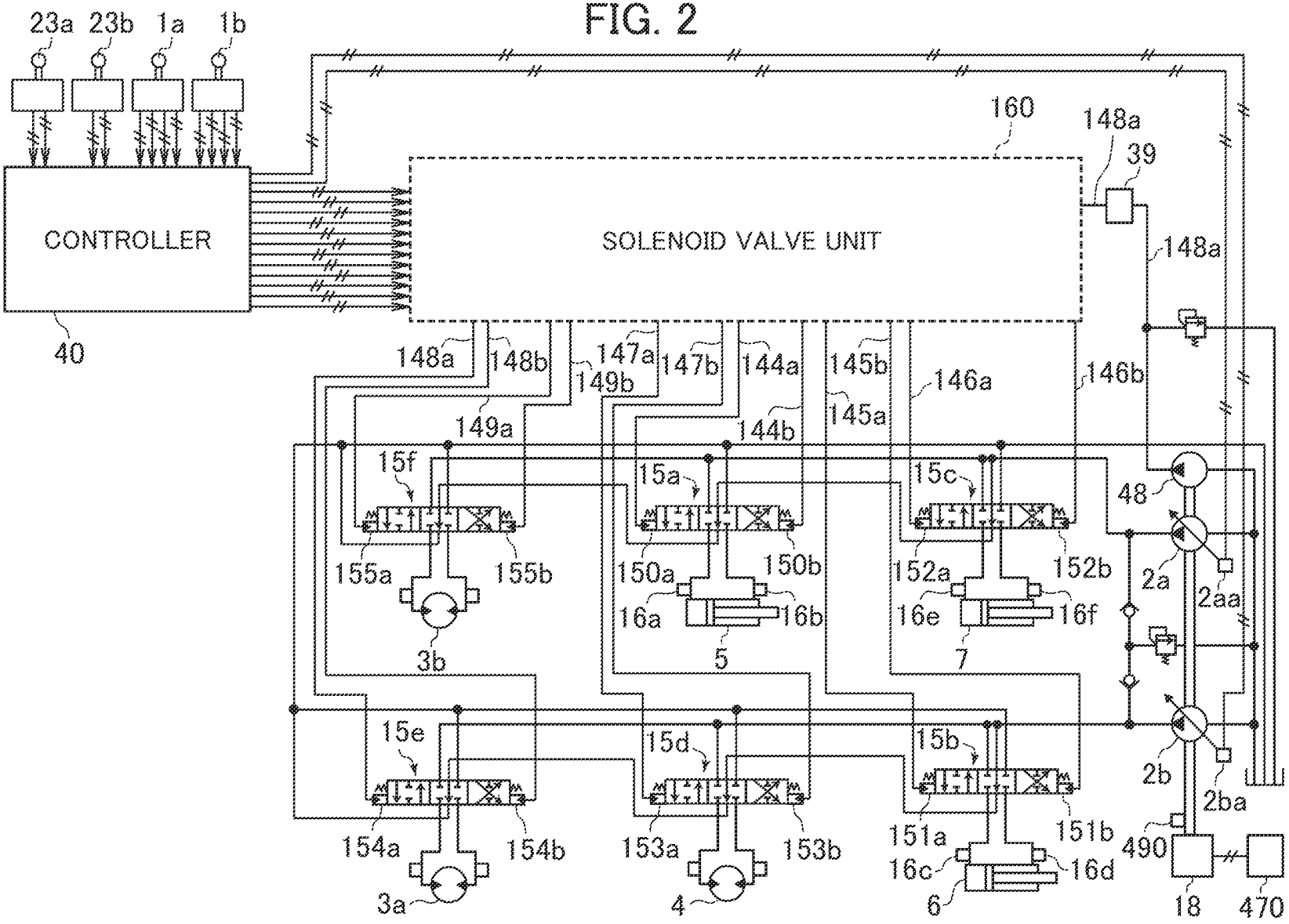
FIG. 2 is a diagram depicting, in an extracting manner, a hydraulic circuit system of the hydraulic excavator together with peripheral configurations such as a controller.

FIG. 1 is a diagram schematically depicting the appearance of a hydraulic excavator as an example of a work machine according to the present embodiment, together with a remote operation device. Besides, FIG. 2 is a diagram depicting, in an extracting manner, a hydraulic circuit system of the hydraulic excavator together with peripheral configurations such as a controller.

In FIG. 1, the hydraulic excavator 100 includes an articulated front work device 1A and a machine body 1B. The machine body 1B of the hydraulic excavator 100 includes a lower track structure 11 that travels by left and right track hydraulic motors 3*a* and 3*b* and an upper swing structure 12 mounted onto the lower track structure 11 and made to swing by a swing hydraulic motor 4. Note that, in FIG. 1, only the left track hydraulic motor 3*b* is illustrated, and the right track hydraulic motor 3*a* is depicted only in FIG. 2.

The front work device 1A has a configuration in which a plurality of driven members (a boom 8, an arm 9, and a bucket 10) each rotated in the vertical direction are coupled to each other. A base end of the boom 8 is supported in a rotatable manner through a boom pin at a front part of the upper swing structure 12. To a tip of the boom 8, the arm 9 is connected in a rotatable manner through an arm pin, and, to a tip of the arm 9, the bucket 10 is connected in a rotatable manner through a bucket pin. The boom 8 is driven by a boom cylinder 5, the arm 9 is driven by an arm cylinder 6, and the bucket 10 is driven by a bucket cylinder 7. Note that in the following description, the boom cylinder 5, the arm cylinder 6, and the bucket cylinder 7 may be collectively referred to as hydraulic cylinders 5 to 7, or hydraulic actuators 5 to 7.

Figure 7:
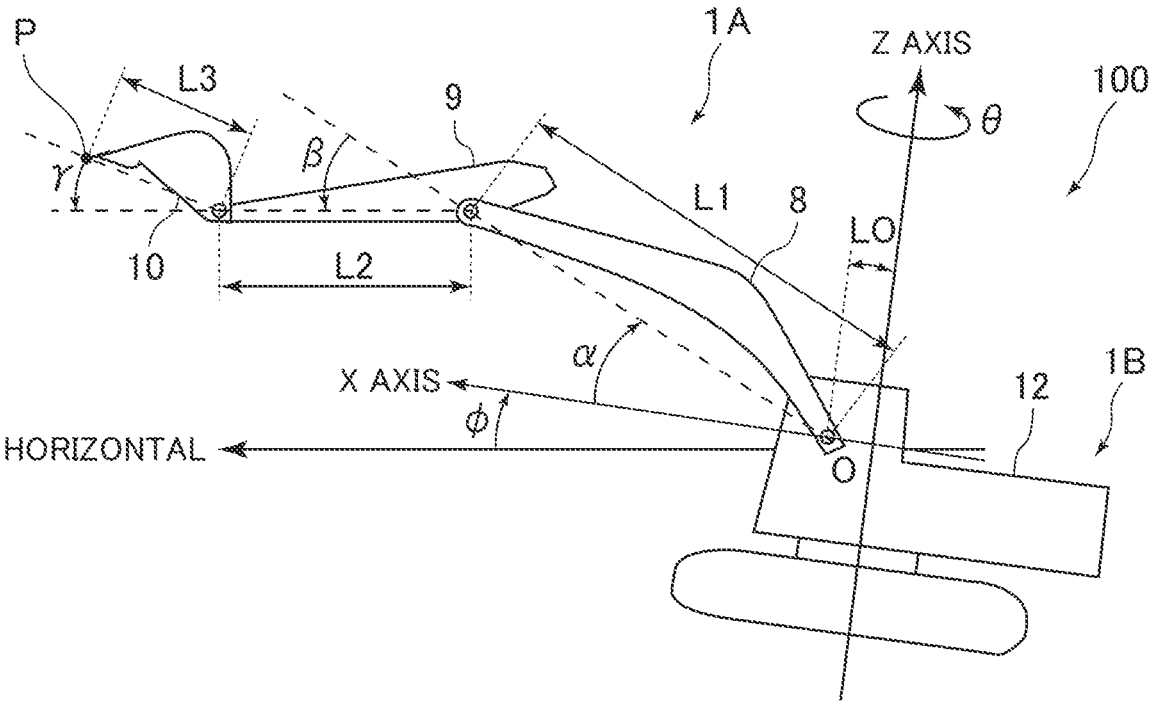
FIG. 7 is a side view for explaining an excavator coordinate system.
Figure 8:
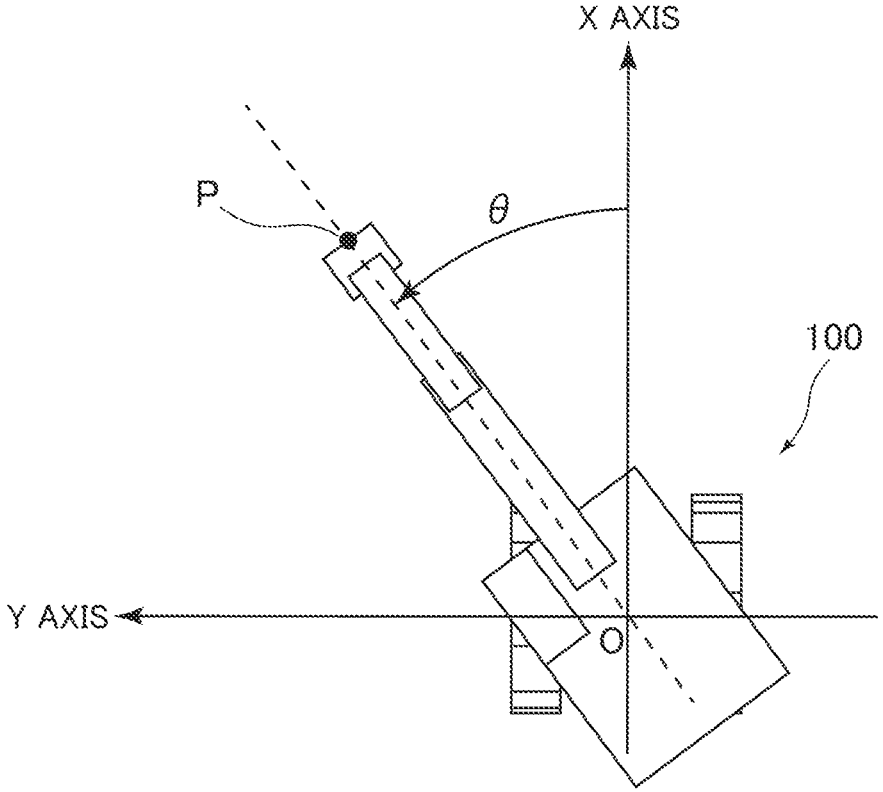
FIG. 8 is a top plan view for explaining the excavator coordinate system.

Here, a hydraulic excavator coordinate system set on the hydraulic excavator will be described. FIGS. 7 and 8 are diagrams for explaining the excavator coordinate system, in which FIG. 7 is a side view, and FIG. 8 is a top plan view.

As depicted in FIGS. 7 and 8, in the present embodiment, an excavator coordinate system (local coordinate system) is defined for the hydraulic excavator 100. The excavator coordinate system is a fixed XYZ coordinate system with respect to the lower track structure 11, and sets a machine body coordinate system having a Z axis that passes through a swing center point in the direction along a swing center axis of the upper swing structure 12 with the upper side being positive, an X axis that is in a direction along a plane on which the front work device 1A operates in a posture in which the upper swing structure 12 faces the front relative to the lower track structure 11 and that passes through a base end of the boom perpendicularly to the Z axis with the front side being positive, and a Y axis that passes through the intersection of the Z axis and the X axis with the viewer's side of the paper surface of FIG. 7 being positive in such a manner as to realize a right hand coordinate system.

In addition, the distance from the intersection of the X axis and the Z axis (origin O) to a base end of the boom is defined as L0, the length of the boom 8 (direct distance between joint parts at both ends) is defined as L1, the length of the arm 9 (direct distance between joint parts at both ends) is defined as L2, the length of the bucket 10 (direct distance between a joint part with the arm and a claw tip) is defined as L3, the angle formed between the boom 8 and an XY plane (relative angle between a straight line in the lengthwise direction and the XY plane) is defined as a rotational angle $\alpha$, the angle formed between the arm 9 and the boom 8 (relative angle of a straight line in the lengthwise direction) is defined as a rotational angle R, the angle formed between the bucket 10 and the arm 9 (relative angle of a straight line in the lengthwise direction) is defined as a rotational angle $\gamma$, and the angle formed between the lower track structure 11 and the upper swing structure 12 (relative angle between the X axis and the center axis of the front device 1A when having a bird's-eye view of the XY plane from the upper side of the Z axis; see FIG. 8) is defined as a rotational angle $\theta$. As a result, the coordinates of the bucket claw tip position in the excavator coordinate system and the posture of the front work device 1A can be represented by L0, L1, L2, L3, $\alpha$, $\beta$, $\gamma$, and $\theta$.

Further, an inclination in the front-rear direction of the machine body 1B of the hydraulic excavator 100 relative to the horizontal plane is defined as an angle $\theta$.

Described with reference to FIG. 1 again, in the front work device 1A, a boom angle sensor 30 is attached to the boom pin, an arm angle sensor 31 is attached to the arm pin, and a bucket angle sensor 32 is attached to a bucket link 13, as posture sensors for measuring the rotational angles $\alpha$, $\beta$, and $\gamma$ of the boom 8, the arm 9, and the bucket 10. Note that although the angle sensors for sensing the relative angles at the joint parts of the plurality of driven members 8, 9, and 10 are exemplified and described as angle sensors 30, 31, and 32 in the present embodiment, these are not limitative; for example, these can be replaced with inertial measurement units (IMUs: Inertial Measurement Units) capable of sensing the relative angles of the plurality of driven members 8, 9, and 10 relative to a reference plane (for example, a horizontal plane).

A machine body inclination angle sensor 33 for sensing the inclination angle $\phi$ of the upper swing structure 12 (the machine body 1B of the hydraulic excavator 100) relative to a reference plane (for example, a horizontal plane) is attached to the upper swing structure 12. For example, an inclination angle sensor of a liquid-filled electrostatic capacitance system, an inertial measurement unit, or the like can be used as the machine body inclination angle sensor 33.

A swing angle sensor 34 for sensing the relative angle $\theta$ of the upper swing structure 12 and the lower track structure 11 is attached to a swing center shaft of the upper swing structure 12 relative to the lower track structure 11.

The angle sensors 30, 31, and 32, the machine body inclination angle sensor 33, and the swing angle sensor 34 constitute a posture sensor.

As depicted in FIGS. 1 and 2, in a cabin provided on the upper swing structure 12, there are disposed an operation device 23*a* for operating the right track hydraulic motor 3*a* of the lower track structure 11; an operation device 23*b* for operating the left track hydraulic motor 3*b* of the lower track structure 11; an operation device 1*a* for operating the boom cylinder 5 driving the boom 8 and the bucket cylinder 7 driving the bucket 10; an operation device 1*b* for operating the arm cylinder 6 of the arm 9 and the swing hydraulic motor 4 of the upper swing structure 12; and an engine speed setter 480 for setting the engine speed of an engine 18 (described later) which is a prime mover mounted on the hydraulic excavator 100. The engine speed setter 480 is, for example, an engine control dial for setting an engine speed according to a rotation operation performed by an operator or the like. In the following, a right track lever 23*a*, a left track lever 23*b*, a right operation lever 1*a*, and a left operation lever 1*b* may generically be referred to as operation devices 1 and 23.

In addition, as depicted in FIG. 1, for example, in a site office or the like, there is provided a remote operation device 800 for remotely operating the hydraulic excavator 100. The remote operation device 800 is provided with configurations similar to those in the cabin of the hydraulic excavator 100, and includes operation devices 801*a*, 801*b*, 823*a*, and 823*b* for generating operation signals that correspond to the operation devices 1 and 23 of the hydraulic excavator 100, an engine speed setter 880 corresponding to the engine speed setter 480 of the hydraulic excavator 100, and a display device 810 for displaying an image of a work position of the front work device 1A of the hydraulic excavator 100 to the operator operating the remote operation device 800. The display device 810 is one or a plurality of monitors or screens (inclusive of projectors); for example, an image picked up by an imaging device (not illustrated) provided at a front upper part of the cabin of the hydraulic excavator 100 is displayed, whereby an image corresponding to the viewpoint of the operator who is seated in the cabin of the hydraulic excavator 100 is presented to the operator operating the remote operation device 800.

Figure 5:
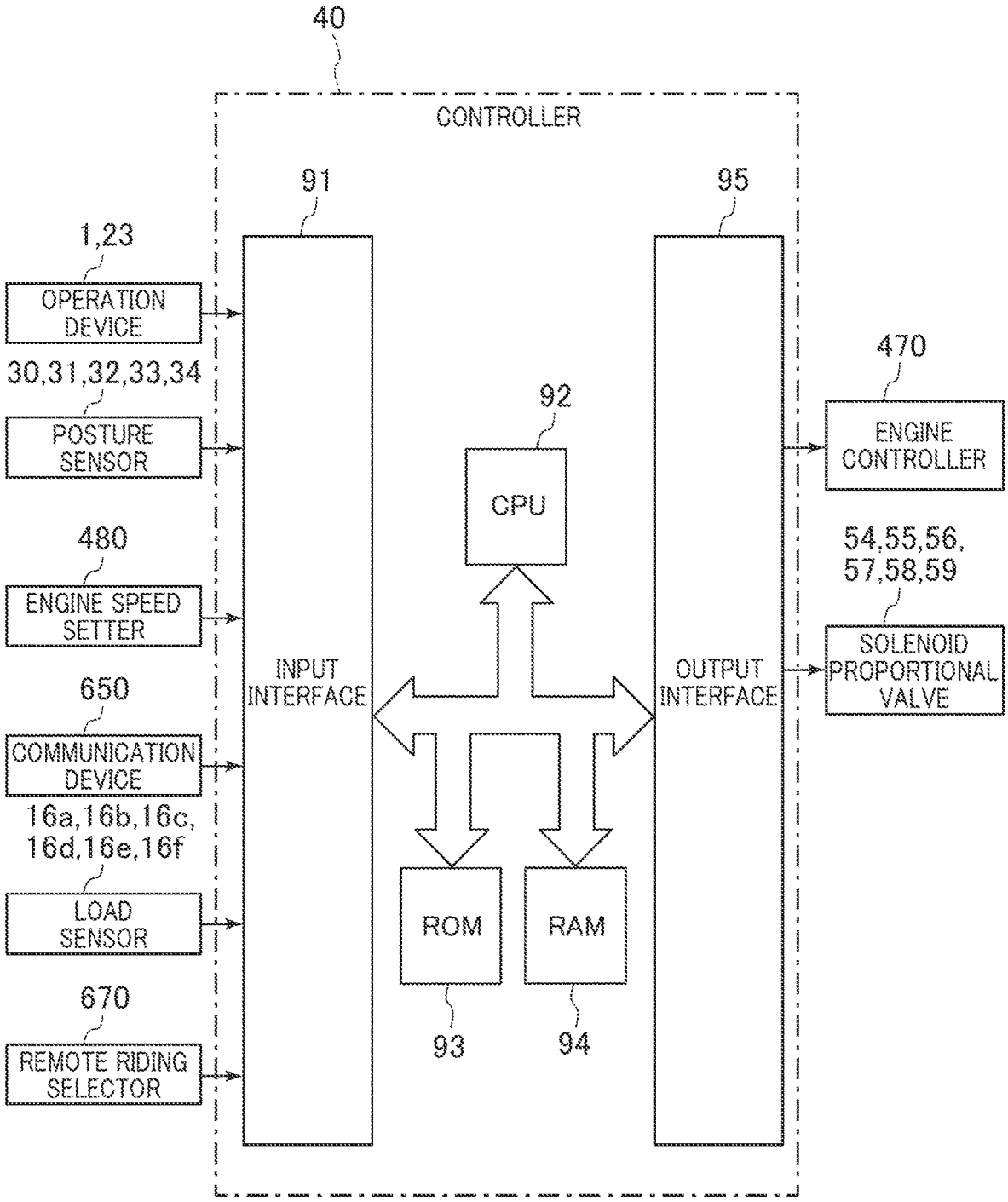
FIG. 5 is a hardware configuration diagram of the controller.
Figure 6:
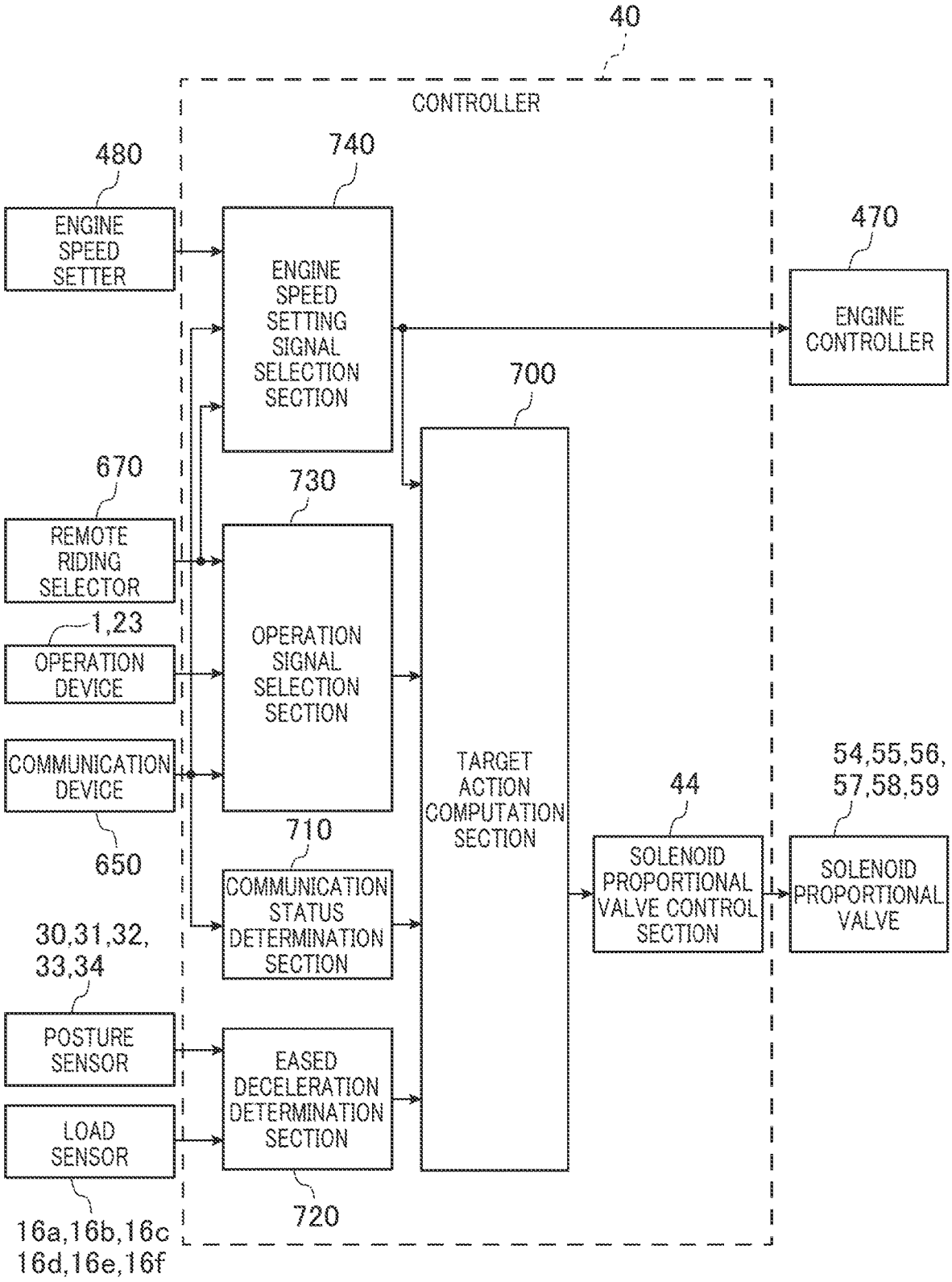
FIG. 6 is a functional block diagram depicting processing functions of the controller.

Operation signals outputted from the operation devices 801 and 823 and a signal outputted from the engine speed setter 880 are transmitted to a controller 40 of the hydraulic excavator 100 through a communication device 850 of the remote operation device 800 and a communication device 650 of the hydraulic excavator 100 (see FIGS. 5 and 6 presented later).

The hydraulic excavator 100 includes a remote/riding selector 670 (see FIG. 5 presented later) that switches the operation state of the hydraulic excavator 100 between a riding operation state and a remote operation state. In the case where the riding operation state is selected, the hydraulic excavator 100 acts on the basis of signals from the operation devices 1 and 23, whereas in the case where the remote operation state is selected, the hydraulic excavator 100 acts on the basis of signals from the operation devices 801 and 823 of the remote operation device 800.

As depicted in FIG. 2, the engine 18 which is a prime mover mounted on the upper swing structure 12 drives the hydraulic pumps 2*a* and 2*b* and a pilot pump 48. The hydraulic pumps 2*a* and 2*b* are variable displacement pumps whose displacement volumes are controlled by regulators 2*aa* and 2*ba*, whereas the pilot pump 48 is a fixed displacement pump. The hydraulic pumps 2 and the pilot pump 48 suck a hydraulic working fluid from a hydraulic working fluid tank. While detailed configurations of the regulators 2*aa* and 2*ba* are omitted, control signals outputted from the controller 40 are inputted to the regulators 2*aa* and 2*ba*, and delivery flow rates of the hydraulic pumps 2*a* and 2*b* are controlled according to the control signals.

The operation devices 1 and 23 are of an electric lever system, and generate electrical signals according to the amount and a direction of an operation performed by the operator and transmit the electrical signals to the controller 40. The controller 40 outputs, to a solenoid valve unit 160, electrical signals for driving solenoid valves 54*a* to 59*a* and 54*b* to 59*b* (see FIGS. 3 and 4 described later) according to operations inputted to the operation devices 1 and 23. The solenoid valves 54 to 59 generate control signals (pilot pressures) for driving the corresponding flow control valves 15*a* to 15*f* according to the electrical signals inputted from the controller 40, from the delivery pressure of the pilot pump 48, and output the control signals to hydraulic driving sections 150*a* to 155*a* and 150*b* to 155*b* of the flow control valves 15*a* to 15*f* through pilot lines 144*a* to 149*a* and 144*b* to 149*b*.

The hydraulic fluid discharged from the hydraulic pumps 2 is supplied to the right track hydraulic motor 3*a*, the left track hydraulic motor 3*b*, the swing hydraulic motor 4, the boom cylinder 5, the arm cylinder 6, and the bucket cylinder 7 through the flow control valves 15*a* to 15*f*. The hydraulic fluid supplied from the hydraulic pumps 2 causes the boom cylinder 5, the arm cylinder 6, and the bucket cylinder 7 to extend or contract, whereby the boom 8, the arm 9, and the bucket 10 are each rotated, and the position and posture of the bucket 10 are varied. In addition, the hydraulic fluid supplied from the hydraulic pumps 2 causes the swing hydraulic motor 4 to rotate, whereby the upper swing structure 12 swings relative to the lower track structure 11. Besides, the hydraulic fluid supplied from the hydraulic pumps 2 causes the right track hydraulic motor 3*a* and the left track hydraulic motor 3*b* to rotate, whereby the lower track structure 11 travels.

The boom cylinder 5, the arm cylinder 6, and the bucket cylinder 7 are provided with load sensors 16*a* to 16*f* for sensing cylinder pressures. The load sensors 16 are, for example, pressure sensors, are provided on the bottom side and the rod side of respective ones of the boom cylinder 5, the arm cylinder 6, and the bucket cylinder 7, and sense and output the pressures as electrical signals to the controller 40. Note that in FIG. 2, connection lines for transmitting the electrical signals from the load sensors 16*a* to 16*f* to the controller 40 are omitted from illustration.

The engine 18 includes an engine speed sensor 490 which is a rotation sensor for sensing the engine speed.

A pump line 148*a* which is a delivery line of the pilot pump 48 is connected to the solenoid valves 54 to 59 inside the solenoid valve unit 160 through a lock valve 39. The lock valve 39 is, for example, a solenoid switch valve, and its solenoid driving section is electrically connected to a position sensor for a gate lock lever (not illustrated) disposed in the cabin. In other words, the position of the gate lock lever is sensed by the position sensor, and a signal according to the position of the gate lock lever is inputted from the position sensor to the lock valve 39, whereby the lock valve 39 is switched between a communicating state and an interrupted state. For example, in the case where the position of the gate lock lever is in a lock position, the lock valve 39 is closed with the pump line 148*a* being interrupted, and the supply of pilot pressures from the pilot pump 48 to the solenoid valves 54 to 59 of the solenoid valve unit 160 is interrupted, whereby operations by the operation devices 1, 23 (or the operation devices 801, 823) are invalidated, and such actions as traveling, swinging, and excavation of the hydraulic excavator 100 are inhibited. In addition, in the case where the gate lock lever is located in an unlock position, the lock valve 39 is opened with the pump line 148*a* being opened, and the supply of the pilot pressures from the pilot pump 48 to the solenoid valves 54 to 59 of the solenoid valve unit 160 is permitted, whereby operations by the operation devices 1 and 23 (or the operation devices 801 and 823) are validated, and such actions as traveling, swinging, and excavation are made possible.

<Solenoid Valve Unit 160>

Figure 3:
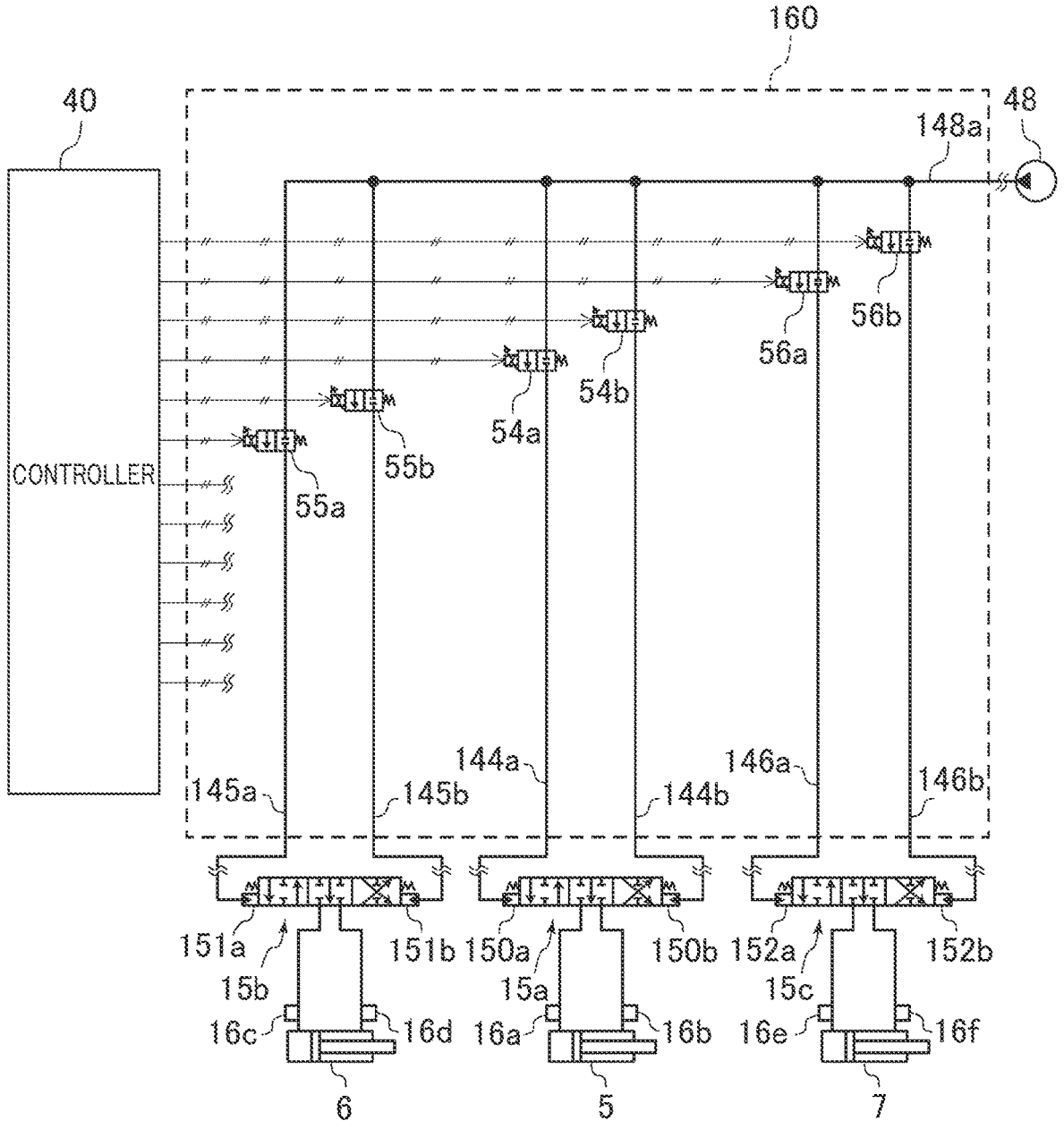
FIG. 3 is a diagram depicting the details of a solenoid valve unit, and is a diagram depicting in an extracting manner configurations concerning a boom cylinder, an arm cylinder, and a bucket cylinder.
Figure 4:
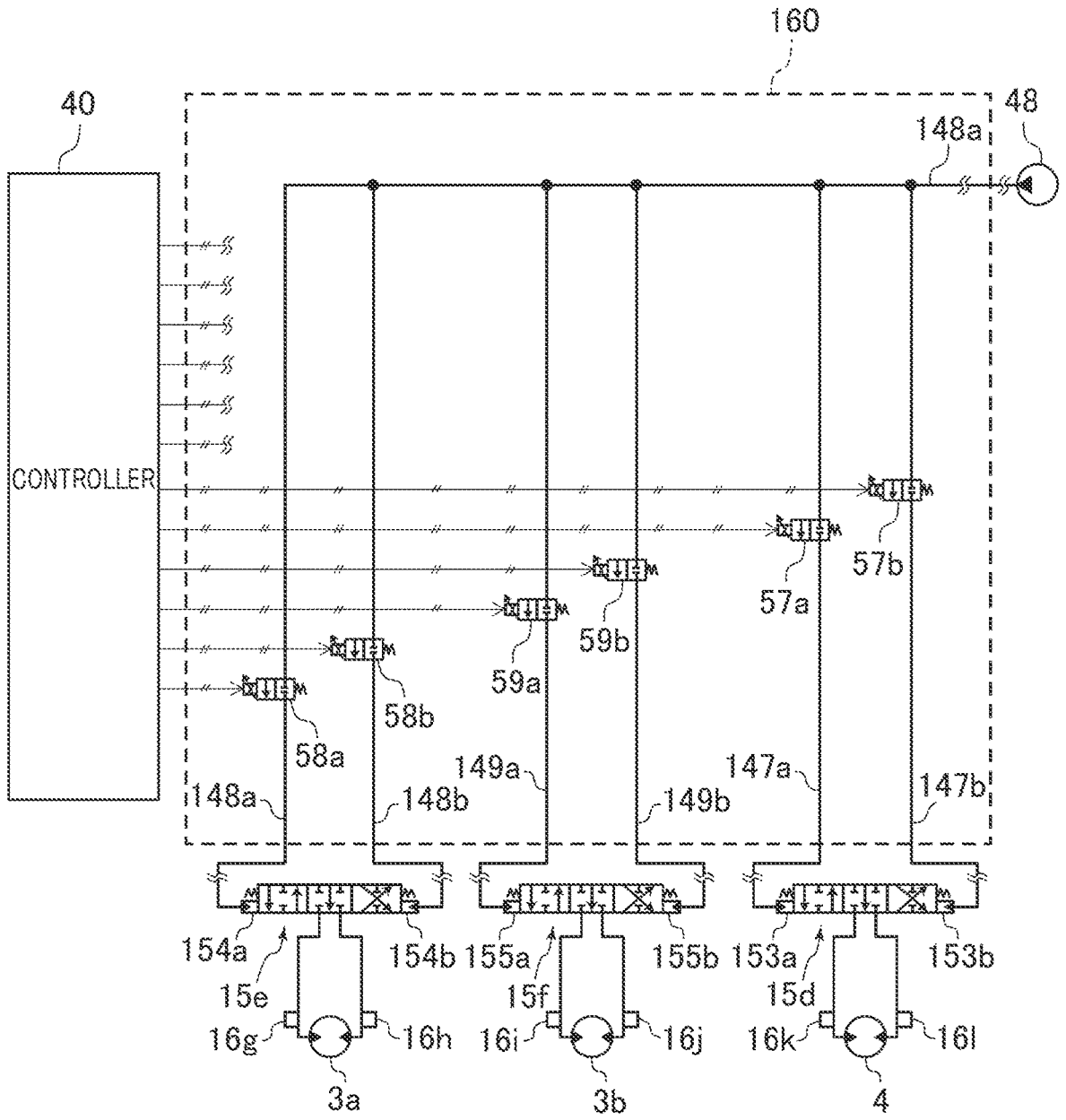
FIG. 4 is a diagram depicting the details of the solenoid valve, and is a diagram depicting in an extracting manner configurations concerning a track hydraulic motor and a swing hydraulic motor.

FIGS. 3 and 4 are diagrams depicting the details of the solenoid valve unit, in which FIG. 3 is a diagram depicting, in an extracting manner, the configurations concerning the boom cylinder, the arm cylinder, and the bucket cylinder, whereas FIG. 4 is a diagram depicting, in an extracting manner, the configurations concerning the track hydraulic motors and the swing hydraulic motor.

As depicted in FIGS. 3 and 4, the solenoid valve unit 160 for front control includes the solenoid proportional valves 54*a* to 59*b* which are connected to the pilot pump 48 through the pump line 148*a* on a primary port side and output the pilot pressure from the pilot pump 48 to the pilot lines 144*a* to 149*b* with pressure reduction.

The openings of the solenoid proportional valves 54*a* to 59*a* and 54*b* to 59*b* are minimum when not energized, and the openings are enlarged as currents which are control signals from the controller 40 are increased. In this way, the openings of the solenoid proportional valves 54*a* to 59*a* and 54*b* to 59*b* correspond to the control signals from the controller 40. In the solenoid valve unit 160, by outputting the control signals from the controller 40 to drive the solenoid proportional valves 54*a* to 59*b*, pilot pressures can be generated even when no operations are performed by the operator on the corresponding operation devices 1 and 23 (or the operation devices 801 and 823), so that actions of the hydraulic actuators 3 to 7 can be caused in a forcible manner.

<Controller 40>

FIG. 5 is a hardware configuration diagram of the controller.

In FIG. 5, the controller 40 has an input interface 91, a central processing unit (CPU) 92 which is a processor, a read only memory (ROM) 93 and a random access memory (RAM) 94 which are storage devices, and an output interface 95. The input interface 91 receives, as inputs, signals indicating operation amounts from the operation devices 1 and 23, signals from a boom angle sensor 30, an arm angle sensor 31, a bucket angle sensor 32, a machine body inclination angle sensor 33, and a swing angle sensor 34 which are posture sensors, a signal from the engine speed setter 480, signals inputted through the communication device 650, signals from the load sensors 16*a* to 16*f*, and a signal from the remote/riding selector 670, and performs conversion (for example, A/D conversion) into a form which can be computed by the CPU 92. The ROM 93 is a storage medium storing a control program for executing a flow chart described later and various kinds of information necessary for executing the flow chart, and the CPU 92 performs predetermined computation processes on the signals taken in from the input interface 91 and the memories 93 and 94, according to the control program stored in the ROM 93. The output interface 95 generates signals for output according to results of computation performed in the CPU 92, and outputs the signals to an engine controller 470 and the solenoid proportional valves 54 to 59 of the solenoid valve unit 160, to thereby drive and control the engine 18 and the actuators 3 to 7. Note that a controller including semiconductor memories such as the ROM 93 and the RAM 94 as the storage device is illustrated as an example of the controller 40 depicted in FIG. 5, but the controller can be replaced with a device having a storage function; for example, the controller may have a configuration including a magnetic storage device such as a hard disk drive.

FIG. 6 is a functional block diagram depicting processing functions of the controller.

As depicted in FIG. 6, the controller 40 includes a solenoid proportional valve control section 44, a target action computation section 700, a communication status determination section 710, an eased deceleration determination section 720, an operation signal selection section 730, and an engine speed setting signal selection section 740.

The operation signal selection section 730 selects signals from the operation devices 1 and 23 and outputs the signals to the target action computation section 700 when the riding operation state is selected by the remote/riding selector 670, and selects signals corresponding to the operation signals (namely, signals from the operation devices 801 and 823) from among signals received by the communication device 650 and outputs the selected signals to the target action computation section 700 when the remote operation state is selected by the remote/riding selector 670.

The engine speed setting signal selection section 740 selects a signal from the engine speed setter 480 and outputs the selected signal to the target action computation section 700 and the engine controller 470 when the riding operation state is selected by the remote/riding selector 670, and selects a signal corresponding to the engine rotational seed setting signal (namely, a signal from the engine speed setter 880) from among signals received from the communication device 650 and outputs the selected signal to the target action computation section 700 and the engine controller 470 when the remote operation state is selected by the remote/riding selector 670.

The communication status determination section 710 extracts, from signals received by the communication device 650, information (time information) concerning the time of transmission of the signals by the remote operation device 800, computes the difference between this time and the time of reception of the signals by the communication device 650 as a communication delay time Tc, and, in the case where the communication delay time Tc is greater than a preset threshold Tc0, determines that the current state is a communication delay state, and outputs the determination result and the communication delay time Tc to the target action computation section 700. In addition, in the case where the communication delay time Tc is not more than the preset threshold Tc0, the communication status determination section 710 determines that the current state is a communication normal state, and outputs the determination result and the communication delay time Tc to the target action computation section 700.

The eased deceleration determination section 720 determines whether or not eased deceleration is to be conducted according to signals from the sensors 30 to 34 which are posture sensors and the pressure sensors 16*a* to 16*f* which are load sensors, and outputs the determination result (eased deceleration flag) and deceleration/acceleration to be used at the time of performing the eased deceleration (eased deceleration determination process). The details of the eased deceleration determination process will be described later.

The target action computation section 700 computes target actuator velocities of the hydraulic actuators corresponding to the operations of the operation devices 1 and 23 (or the operation devices 801 and 823), on the basis of operation signals selected and outputted by the operation signal selection section 730 and signals selected and outputted by the engine speed setting signal selection section 740, corrects the target actuator velocities on the basis of the results of determination made by the communication status determination section 710 and the eased deceleration determination section 720, and outputs the corrected target actuator velocities to the solenoid proportional valve control section 44 (target actuator velocity computation and correction process). The details of the target actuator velocity computation and correction process will be described later.

The solenoid proportional valve control section 44 generates control signals (control command values) according to the target actuator velocities outputted from the target action computation section 700, and outputs the control signals to the corresponding solenoid proportional valves 54 to 59.

<Eased Deceleration Determination Process (Eased Deceleration Determination Section (720)>

Figure 9:
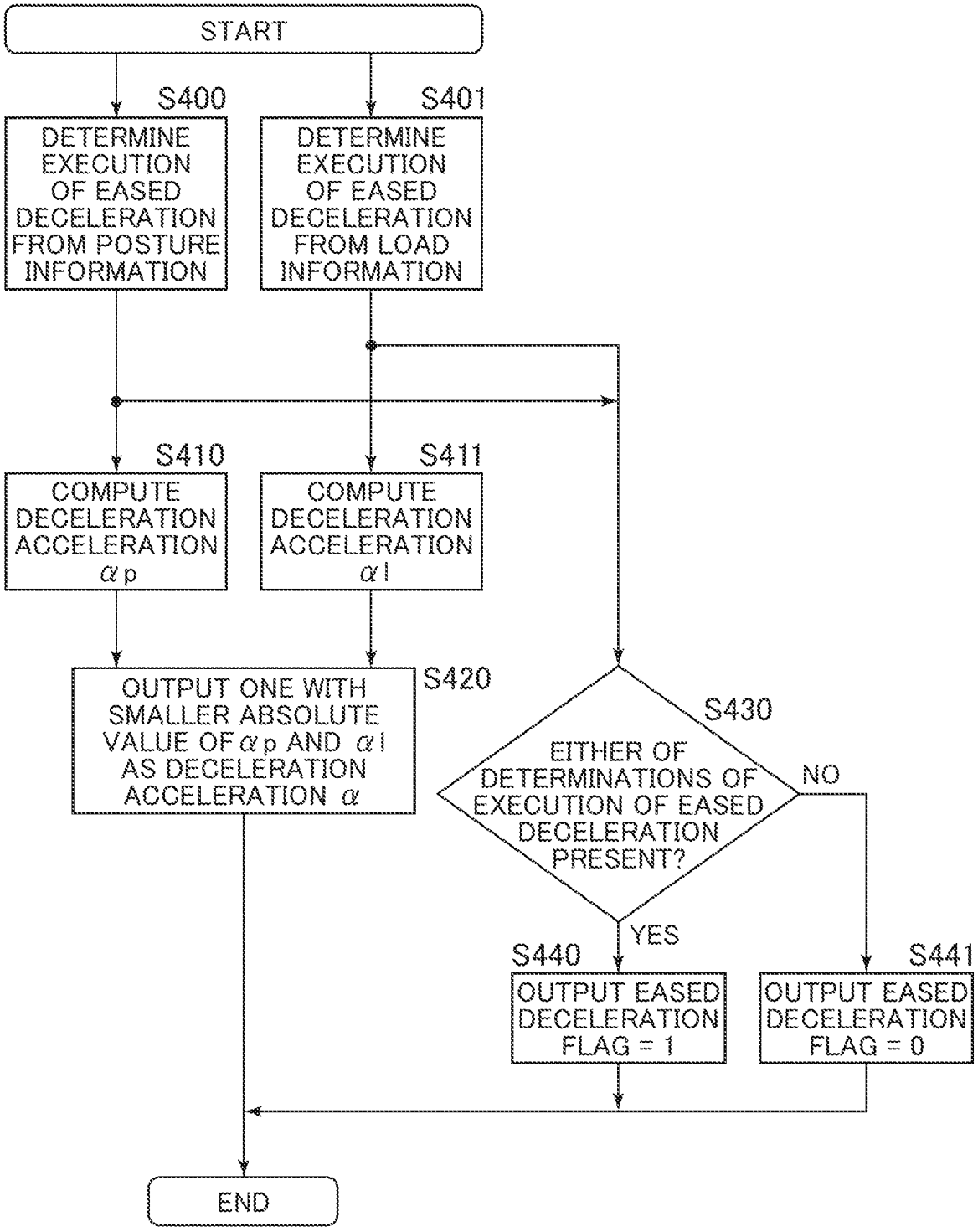
FIG. 9 is a flow chart depicting an eased deceleration determination process of an eased deceleration determination section.

FIG. 9 is a flow chart depicting an eased deceleration determination process of an eased deceleration determination section.

The eased deceleration determination section 720, first, determines whether or not an eased deceleration is to be conducted, on the basis of signals sensed from the posture sensors 30 to 34 (step S400), and, subsequently, computes deceleration/acceleration αp according to the posture information (step S410).

In addition, concurrently with the processes of steps S400 and S410, whether or not an eased deceleration is to be performed is determined on the basis of signals sensed from the load sensors 16*a* to 16*f* (step S401), and, subsequently, deceleration/acceleration al according to the load information is computed (step S411).

When the processes of steps S410 and S411 are completed, subsequently, one with a smaller absolute value of the deceleration/acceleration αp and the deceleration/acceleration αl is outputted (step S420).

In addition, regarding the determination results of steps S400 and S401, whether or not at least either one of the determination results is a determination result indicating that eased deceleration is to be executed is determined (step S430), and, when the determination result is YES, that is, in the case where the determination result indicating that the eased deceleration is to be executed is present, an eased deceleration flag=1 is outputted (step S440). Alternatively, in the case where the determination result in step S430 is NO, that is, in the case where the determination result indicating that the eased deceleration is to be executed is absent, an eased deceleration flag=0 (zero) is outputted (step S441).

Here, as a method for determining execution of the eased deceleration in steps S400 and S401, there is, for example, a method of using ZMP (Zero Moment Point) equation. In the case where the ZMP system is used, stability is assessed from deceleration/acceleration of the case where the action of the hydraulic excavator 100 is assumed to be suddenly stopped, and whether or not the eased deceleration is to be executed is determined on the basis of the assessment result. Note that the determination of execution of the eased deceleration is not limited to being performed by the above-described method; for example, a fixed value may be obtained from a preliminary simulation or a real machine test, or determination may be made on the basis of a determination threshold preset as to a predetermined posture.

<Target Actuator Velocity Computation and Correction Process (Target Action Computation Section (700)>

Figure 10:
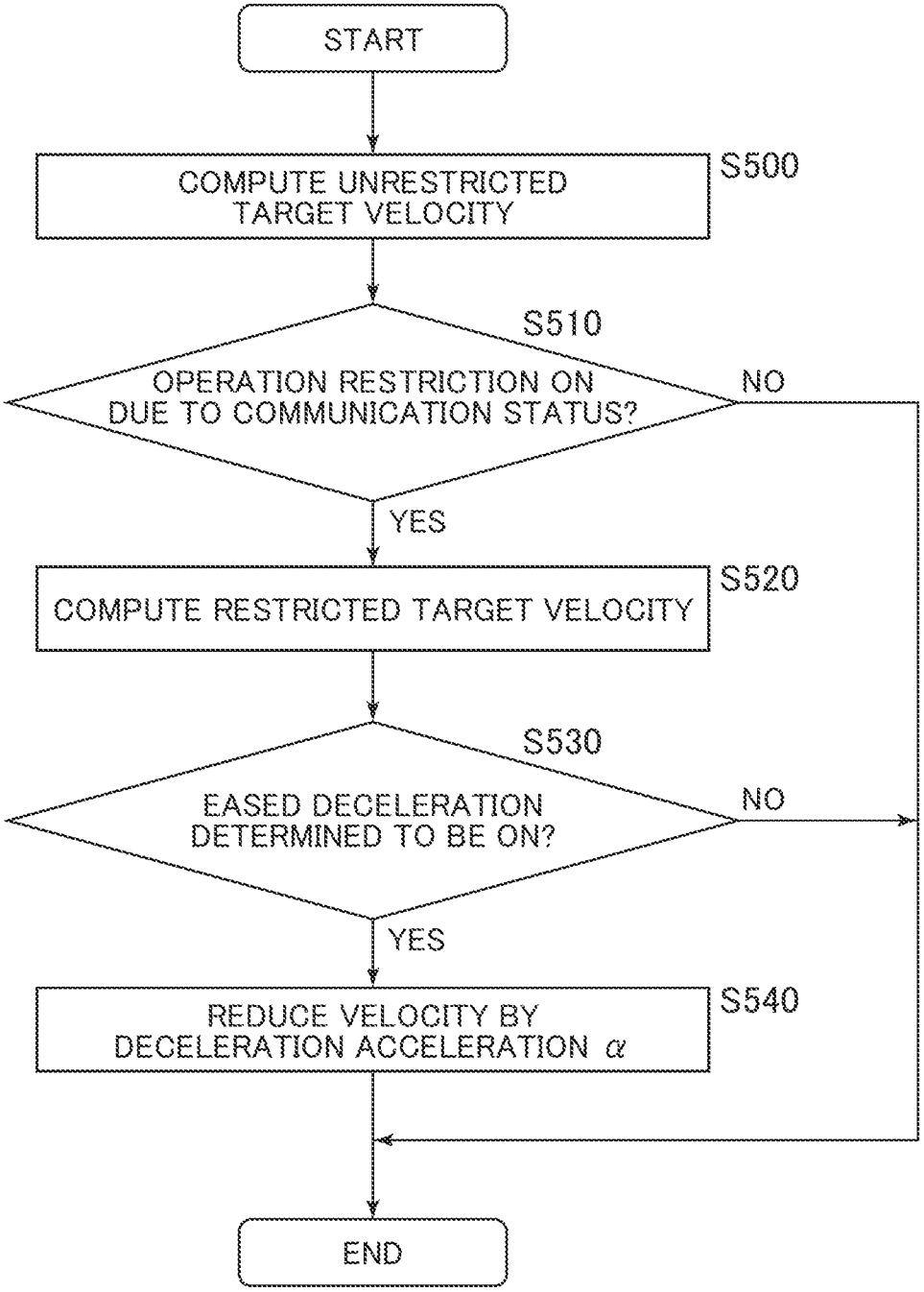
FIG. 10 is a flow chart depicting a target actuator velocity computation and correction process of a target action computation section.
Figure 11:
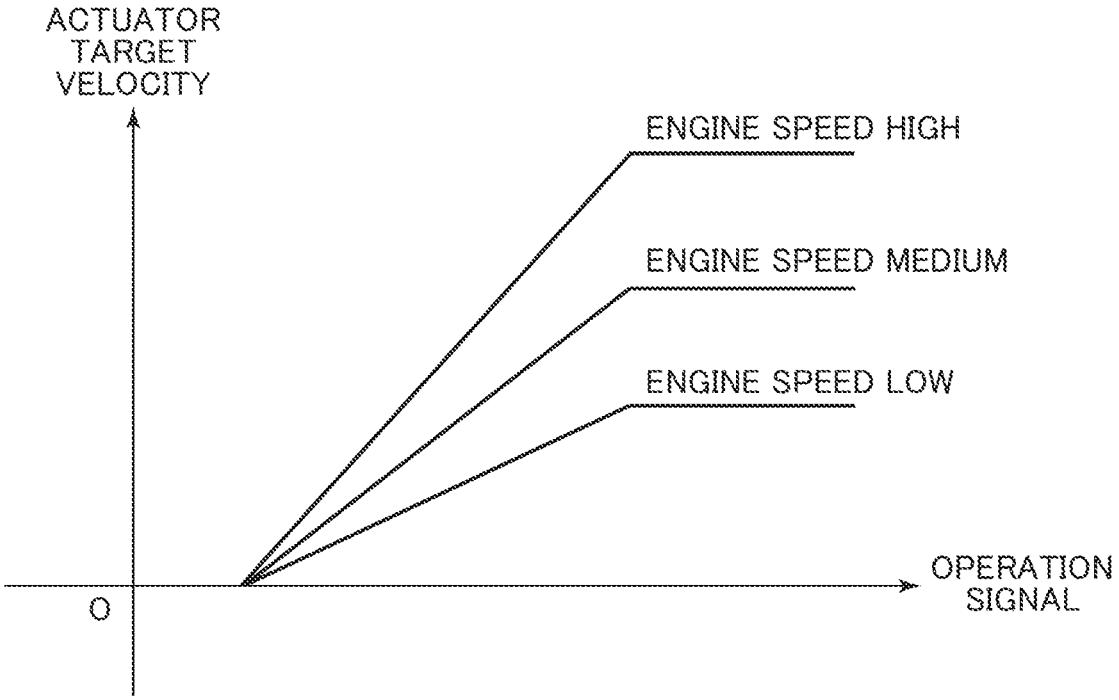
FIG. 11 is a diagram depicting the relation between an operation signal and an actuator target velocity.
Figure 12:
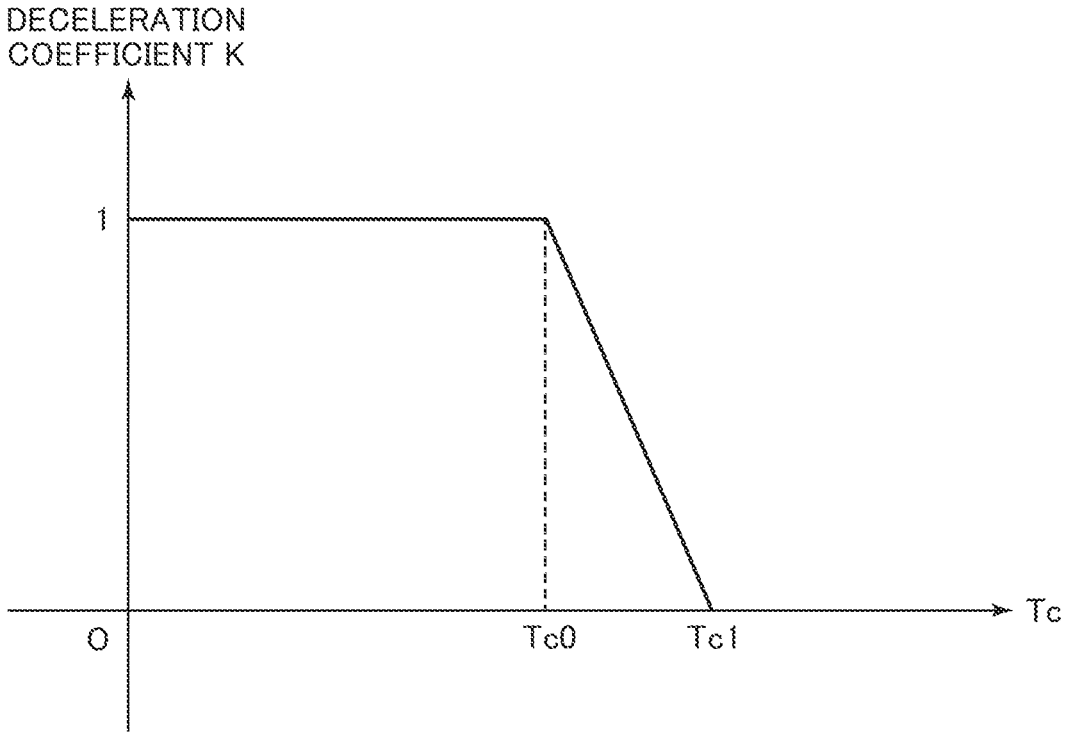
FIG. 12 is a diagram depicting the relation between a communication delay time and a deceleration coefficient.

FIG. 10 is a flow chart depicting a target actuator velocity computation and correction process of a target action computation section.

The target action computation section 700, first, computes a target velocity of an actuator by use of a predetermined table (see FIG. 11), on the basis of operation signals outputted from the operation signal selection section 730 and an engine speed setting signal outputted from the engine speed setting signal selection section 740 (step S500).

Subsequently, on the basis of the determination result outputted by the communication status determination section 710, whether or not an action restriction is to be performed is determined (step S510). An action restriction is conducted in the case where the determination result made by the communication status determination section 710 is a communication delay state, whereas the action restriction is not performed in the case where the determination result is a communication normal state.

In the case where the determination result in step S510 is YES, that is, in the case where the determination result made by the communication status determination section 710 is a communication delay state, a deceleration coefficient K is computed on the basis of a communication delay time Tc, by use of a predetermined table (see FIG. 12), and a restricted target velocity is computed by multiplying the target velocity of the actuator obtained in step S500 by the deceleration coefficient K (step S520).

Subsequently, whether or not the determination result made by the eased deceleration determination section 720 indicates that the eased deceleration is to be executed is determined (step S530), and, in the case where the determination result is YES, such a target velocity of the actuator as to reach the target velocity of the actuator computed in step S520 with deceleration/acceleration α is outputted (step S540).

In addition, in the case where the determination result in step S510 is NO, that is, in the case where the current state is a communication normal state and an action restriction is not to be conducted, or in the case where the determination result in step S530 is NO, that is, in the case where eased deceleration is not to be conducted, the target velocity of the actuator obtained in step S500 or step S520 is outputted as a final value.

Effects of the present embodiment configured as above will be described.

Figure 13:
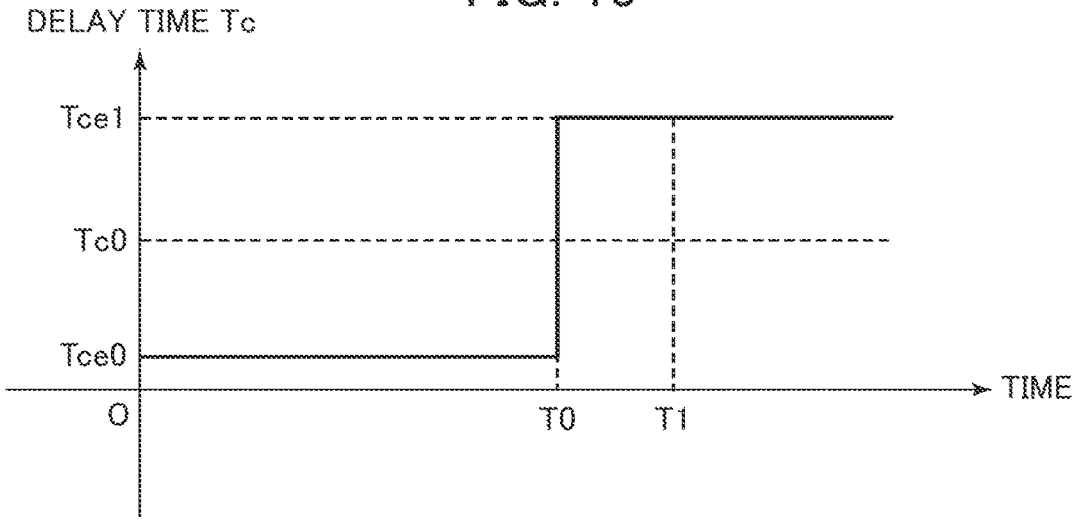
FIG. 13 is a diagram depicting an example of variation in the communication delay time with lapse of time.
Figure 14:
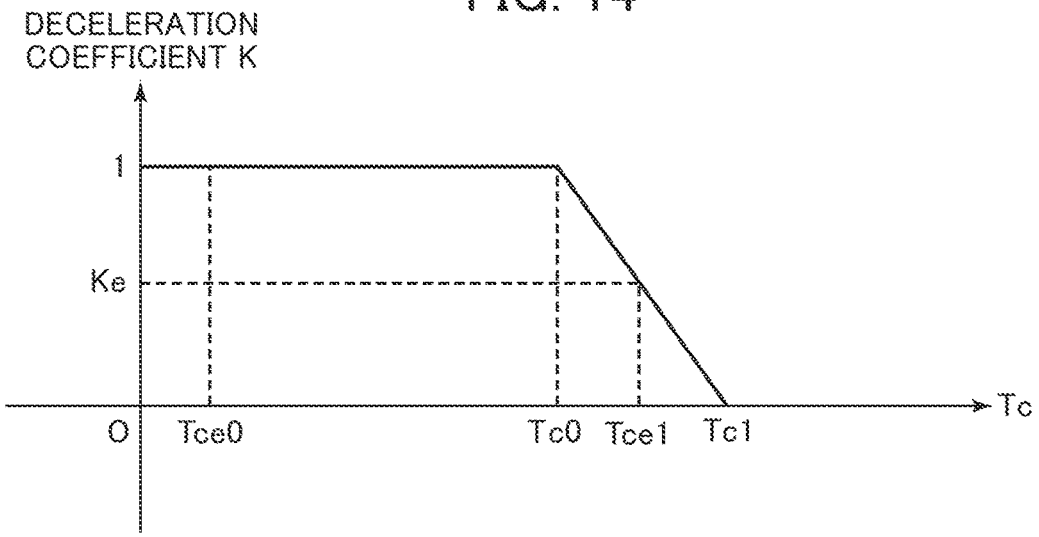
FIG. 14 is a diagram depicting an example of variation in the deceleration coefficient K with lapse of time.
Figure 15:
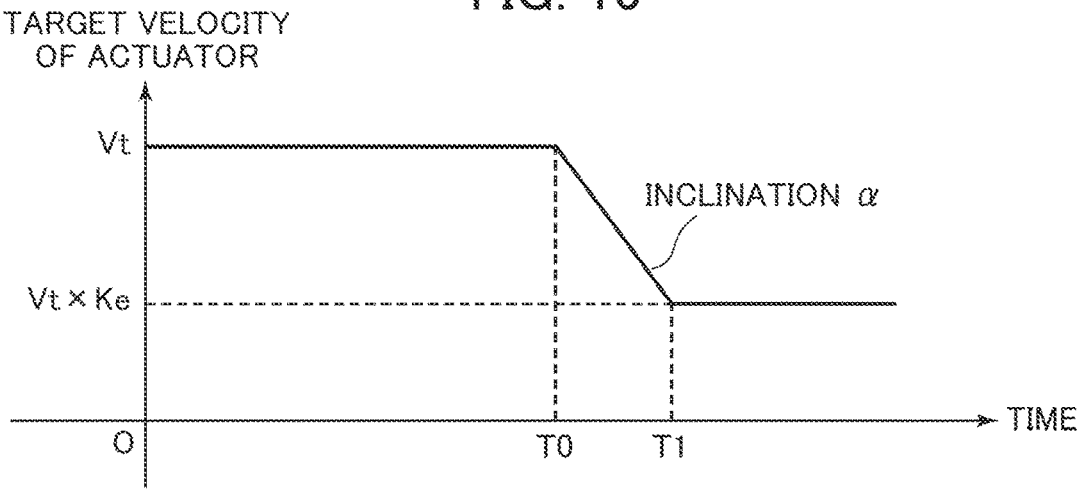
FIG. 15 is a diagram depicting an example of variation in an actuator target velocity with lapse of time.

FIG. 13 is a diagram depicting an example of variation in a communication delay time with lapse of time, FIG. 14 is a diagram depicting an example of variation in the deceleration coefficient K with lapse of time, and FIG. 15 is a diagram depicting an example of variation in the actuator target velocity with lapse of time.

A case where the communication delay time Tc changes from Tce0 to Tce1 at time T0, as depicted in FIG. 13, will be illustrated as an example. Note that the hydraulic excavator 100 is in a status in which sufficient earth is loaded in the bucket 10 and eased deceleration is determined to be necessary.

(1) On and Before Time T0

On and before time T0, the communication delay time Tc is Tce0, which is not more than the threshold Tc0, so that the communication status determination section 710 determines an action restriction to be unnecessary. Hence, an action restriction based on the communication status is not to be turned ON by the target action computation section 700 (see S510 in FIG. 10), so that the target velocity Vt (see S500 in FIG. 10) of the actuator is outputted as it is (see FIG. 15).

(2) Time T0 to Time T1

As depicted in FIG. 13, the communication delay time Tc becomes Tce1 from time T0 on. The communication status determination section 710 determines that an action restriction is necessary, since Tce1 is greater than the threshold Tc0. In this instance, the action restriction is turned ON by the target action computation section 700 (see S510 in FIG. 10), and a restricted target velocity is computed (see S520 in FIG. 10).

As depicted in FIG. 14, the deceleration coefficient when the communication delay time Tc is Tce1 is Ke, so that Vt×Ke obtained by multiplying the target velocity Vt (see S500 in FIG. 10) of the actuator by Ke is outputted as a target velocity of the actuator (S520 in FIG. 10).

Besides, the eased deceleration determination section 720 determines that eased deceleration is to be conducted, from the status of a load on the bucket (see S530 in FIG. 10), and deceleration/acceleration α at this time is outputted. In this instance, a target velocity of the actuator is outputted in such a manner that the deceleration/acceleration becomes a (the inclination is α) as in the period from T0 to T1 in FIG. 15.

(3) From Time T1 On

From time T1 on, though eased deceleration is determined to be conducted (see S530 in FIG. 10), deceleration has been completed, so that Vt×Ke is outputted as a target velocity of the actuator.

(4) Case where Communication Delay Time Tc is not Less than Tc1

While the case where the communication delay time Tc changes from Tce0 to Tce1 has been exemplified in (1) to (3) above, it is further set in FIG. 14 that the deceleration coefficient K=0 (that is, Ke=0) in the case where the communication delay time Tc is not less than a predetermined Tc1. In this case, when the communication delay time becomes equal to or more than Tc1, the actuator velocity Vt×Ke exemplified in FIG. 15 becomes 0 (zero), so that an action of the actuator can securely be stopped.

In the present embodiment configured as above, the action can appropriately be restricted according to a communication status, while worsening of workability due to scattering of a load or lowering in the stability of the work machine caused by a sudden stop is suppressed.

Second Embodiment

A second embodiment of the present invention will be described with reference to FIG. 16.

The present embodiment exemplifies a case where a different table is used in the computation of a restricted actuator target velocity in the first embodiment (see S520 in FIG. 10).

Figure 16:
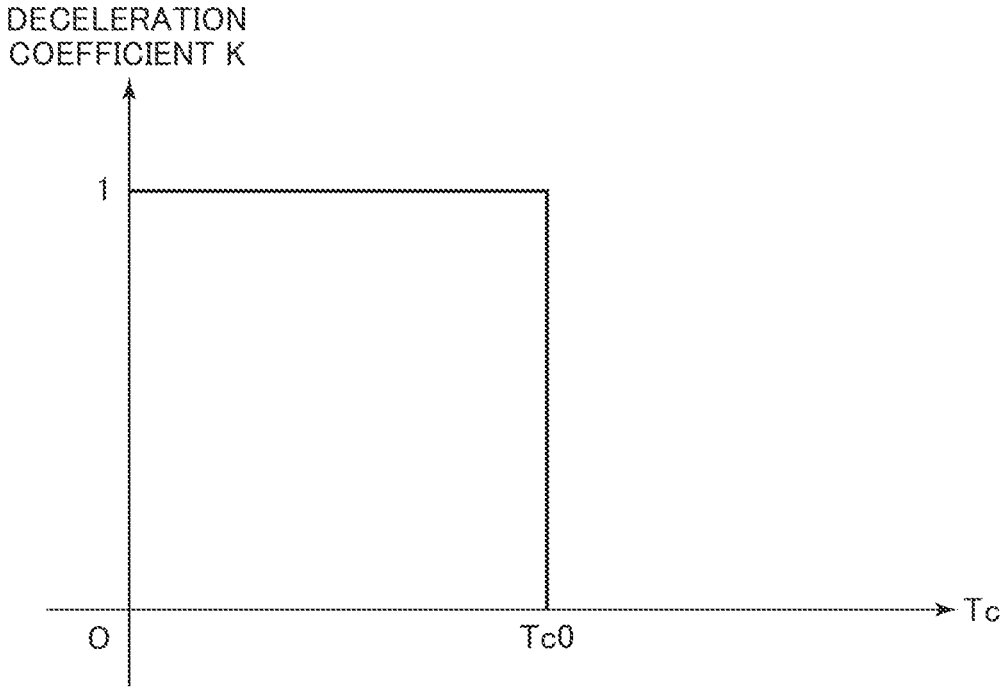
FIG. 16 is a diagram depicting an example of a table in which the relation between the communication delay time and the deceleration coefficient is set.

FIG. 16 is a diagram depicting an example of a table in which the relation between communication delay time and deceleration coefficient is set. In the figure, the items similar to those in the first embodiment above are denoted by the same reference characters as used above, and descriptions thereof will be omitted.

As depicted in FIG. 16, in the present embodiment, when a restricted actuator target velocity is to be computed in the target action computation section 700 (see S520 in FIG. 10), the actuator target velocity is set to be 0 (zero).

In this case, Vt×Ke in FIG. 15 is replaced with 0 (zero), so that the action of the hydraulic excavator 100 is finally stopped, but, since eased deceleration is performed, worsening of workability can be prevented as in the first embodiment.

<Additional Remark>

Note that the present invention is not limited to the above-described embodiments, and includes various modifications or combinations within such a scope as not to depart from the gist of the invention. In addition, the present invention is not limited to those embodiments which include all the configurations described in the above embodiments, and includes those embodiments in which some of the configurations is omitted.

For example, while the angle sensors for sensing the angles of the boom 8, the arm 9, and the bucket 10 are used in the embodiments of the present invention, the posture information concerning the excavator may be computed not by the angle sensors but by cylinder stroke sensors. In addition, while description has been made by taking an electric lever type excavator as an example, a configuration in which command pilot pressures generated by hydraulic pilots are controlled in the case of a hydraulic pilot type excavator may also be adopted.

Besides, while the embodiments of the present invention have been described by illustrating the hydraulic excavator as an example of the work machine, this is not limitative, and the present invention may be applied, for example, to other work machines such as a wheel loader or a crane.

In addition, while the case in which all the functions are provided in the controller 40 of the hydraulic excavator 100 has been illustrated as an example in the embodiments of the present invention, a configuration in which some of the functions are disposed in the remote operation device 800 or in a server or the like through which communication is realized may also be adopted.

Besides, while a configuration in which the target velocity of an actuator is restricted has been illustrated in the embodiments of the present invention, a configuration in which operation signals as input signals are restricted or in which engine speed is reduced may also be adopted.

In addition, while the communication delay time Tc has been computed by the difference between the transmission time of the remote operation device 800 and the reception time of the communication device 650 in the embodiments of the present invention, the communication device 650 may transmit a signal to the remote operation device 800, the remote operation device 800 may send back the signal to the communication device 650 without any change, and the communication delay time Tc may be computed from the time taken for the transmission and return.

Besides, while the computation section for computing the communication delay time Tc has been disposed in the controller 40 of the hydraulic excavator 100 in the embodiments of the present invention, this is not limitative, and a configuration in which the computation section is provided in the remote operation device 800 or in a server or the like through which communication between the remote operation device 800 and the communication device 650 is realized and the communication delay time Tc is transmitted to the communication device 650 may also be adopted.

In addition, of the above-described configurations, functions, and the like, a part or the whole part may be realized by designing, for example, as integrated circuits. Besides, the above-described configurations, functions, and the like may be realized on a software basis by interpreting and executing the programs for realizing the respective functions by a processor.

DESCRIPTION OF REFERENCE CHARACTERS

1: Operation device
1*a*: Right operation lever
1A: Front work device
1*b*: Left operation lever
1B: Machine body
2: Hydraulic pump
2*aa*, 2*ba*: Regulator
3*a*, 3*b*: Track hydraulic motor
4: Swing hydraulic motor
5: Boom cylinder
6: Arm cylinder
7: Bucket cylinder
8: Boom
9: Arm
10: Bucket
11: Lower track structure

12: Upper swing structure
13: Bucket link
15*a* to 15*f*: Flow control valve
16*a* to 16*f*: Pressure sensor
18: Engine
23: Operation device
30 to 32: Angle sensor
33: Machine body inclination angle sensor
34: Swing angle sensor
39: Lock valve
40: Controller
44: Solenoid proportional valve control section
48: Pilot pump
54: Solenoid proportional valve
91: Input interface
92: CPU
93: ROM
94: RAM
95: Output interface
100: Hydraulic excavator
160: Solenoid valve unit
470: Engine controller
480: Engine speed setter
490: Engine speed sensor
650: Communication device
670: Remote/riding selector
700: Target action computation section
710: Communication status determination section
720: Eased deceleration determination section
730: Operation signal selection section
740: Engine speed setting signal selection section
800: Remote operation device
801: Operation device
801*a*: Operation device
801*b*: Operation device
810: Display device
823: Operation device
823*a*: Operation device
823*b*: Operation device
850: Communication device
880: Engine speed setter

The invention claimed is:

1. A work machine including a front work device, the work machine comprising:

a state amount sensor that senses a state amount relating to an action state of the front work device; and a controller that controls the action of the work machine on a basis of an operation signal transmitted from a remote operation device by radio communication, wherein the state amount sensor includes a posture sensor that senses posture information that is information relating to a posture of the work machine and a load sensor that senses load information that is information relating to a load on the front work device of the work machine, and the controller is configured to assess a communication status of the radio communication, and, when restricting the action of the work machine according to a result of the assessment, restrict the action of the work machine according to one with a smaller absolute value of deceleration acceleration according to the posture information and deceleration acceleration according to the load information.

* * * * *